US006279201B1

(12) United States Patent
Jonasson et al.

(10) Patent No.: US 6,279,201 B1
(45) Date of Patent: Aug. 28, 2001

(54) DEVICE FOR DISTRIBUTING PARTICLES

(75) Inventors: Stellan Jonasson; Heikki Salo, both of Växjö; Lars-Erik Johansson, Älmeboda, all of (SE)

(73) Assignee: Valmet Fibertech AB (SE)

( * ) Notice: Subject to any disclaimer, the term of this patent is extended or adjusted under 35 U.S.C. 154(b) by 0 days.

(21) Appl. No.: 09/646,587

(22) PCT Filed: Mar. 22, 1999

(86) PCT No.: PCT/SE99/00444

§ 371 Date: Sep. 19, 2000

§ 102(e) Date: Sep. 19, 2000

(87) PCT Pub. No.: WO99/48658

PCT Pub. Date: Sep. 30, 1999

(30) Foreign Application Priority Data

Mar. 20, 1998 (SE) ..... 9800976

(51) Int. Cl.[7] ..... D01G 25/00

(52) U.S. Cl. ..... 19/308; 19/296; 19/304

(58) Field of Search ..... 19/105, 144, 145, 19/145.3, 145.5, 145.7, 300, 301, 302, 303, 304, 305, 296; 156/62.2, 322, 499; 209/17, 135, 138, 139.1; 406/98, 106, 168, 12

(56) References Cited

U.S. PATENT DOCUMENTS

| | | | | |
|---|---|---|---|---|
| 3,228,067 | * | 1/1966 | Strang et al. | 19/296 |
| 3,862,472 | * | 1/1975 | Norton et al. | 19/145.5 |
| 4,489,462 | * | 12/1984 | Dodson, Jr. | 19/306 |
| 4,712,277 | | 12/1987 | Gustavsson | 19/269 |
| 5,007,137 | | 4/1991 | Graute | 19/269 |
| 5,205,018 | * | 4/1993 | Leifeld et al. | 19/145.5 |
| 5,303,455 | * | 4/1994 | Leifeld | 19/304 |
| 5,737,806 | * | 4/1998 | Leifeld et al. | 19/305 |

* cited by examiner

*Primary Examiner*—John J. Calvert
*Assistant Examiner*—Gary L. Welch
(74) *Attorney, Agent, or Firm*—Lerner, David, Littenberg, Krumholz & Mentlik, LLP

(57) ABSTRACT

Apparatus is disclosed for separating particles disposed in a carrier gas being delivered from a distributor to a moving web including a roller, a supply conduit for supplying the particles dispersed in the carrier gas substantially tangentially to the roller at a first speed, the roller rotating at a second speed which is substantially greater than the first speed whereby the particles are separated from the carrier gas, the roller including a discharge opening for discharging the particles toward the moving web and a return line for recycling the carrier gas. A method for separating particles dispersed in a carrier gas is also disclosed.

18 Claims, 1 Drawing Sheet

DEVICE FOR DISTRIBUTING PARTICLES

FIELD OF THE INVENTION

The present invention relates to a device for separating particles, preferably wood fibers dispersed in a carrier gas, from a distribution means for distributing the particles on a running web, such as in the manufacture of wood fiberboard.

BACKGROUND OF THE INVENTION

In forming stations for the manufacture of wood fiberboard there is a demand for distributing glue-coated wood fibers onto a wire or belt to form a layer of a certain definite thickness. The layer of wood fibers is transported by the wire or belt to a press installation, in which the wood fibers by the effect of pressure and temperature are pressed into the form of a coherent board.

A device of this kind is described in Swedish Patent No. 457,729, the object of which is to provide a material web having a uniform material distribution. This is achieved by a carrier gas containing wood fibers being supplied tangentially to a convex surface, where fine grained fibers, by the action of the so-called Coanda-effect follow along with the carrier gas along the convex surface to a first outlet, which opens to an endless permeable web, while coarse grained fibers and lumps follow a substantially straight path to a second outlet, which is connected to a line for re-circulation of the fibers. In connection with the endless web there is provided a suction box for collecting and recycling the carrier gas. Although this arrangement has operated satisfactorily, it was found at certain applications that the carrier gas has caused eddy formation, with non-uniform material distribution as a result thereof.

The present invention has an object of separating the particles from the carrier gas and producing a homogenous layer with uniform distribution of particles across the width of the material web.

SUMMARY OF THE INVENTION

In accordance with the present invention, this and other objects have now been realized by the invention of apparatus for separating particles dispersed in a carrier gas being delivered from a distributor to a moving web, the apparatus comprising a rotatable roll, supply means for supplying the particles dispersed in the carrier gas substantially tangentially to the rotatable roll at a first predetermined speed, means for rotating the rotatable roll at a second predetermined speed, the second predetermined speed being substantially greater than the first predetermined speed whereby the particles are separated from the carrier gas, the rotatable roll including a discharge opening for discharging the particles towards the moving web, and a return line for recycling the carrier gas. Preferably, the particles comprise wood fibers, and most preferably the moving web is adapted for the manufacture of wood fiberboard.

In accordance with one embodiment of the apparatus of the present invention, the discharge opening is adapted to open freely to a space directed towards the moving web. In a preferred embodiment, the supply means and the return line partially enclose the rotatable roll, and the apparatus includes a partition wall for substantially providing a seal between the supply means and the return line at an upper portion of the rotatable roll. Preferably, the supply means includes a lower edge and the return line includes a lower edge, and the discharge opening is defined by the lower edges of the supply means and the return line.

In accordance with one embodiment of the apparatus of the present invention, the second predetermined speed is from about two to ten times the first predetermined speed. More preferably, the second predetermined speed is from about five to eight times the first predetermined speed.

In accordance with another embodiment of the apparatus of the present invention, the return line includes an opening, and the return line is disposed directly adjacent to the rotatable roll and the opening substantially upstream of the rotatable roll.

In accordance with the present invention, a method has also been devised for separating particles dispersed in a carrier gas being delivered from a distributor to a moving web, the method comprising rotating a rotatable roll, supplying the particles dispersed in the carrier gas substantially tangentially to the rotatable roll at a first predetermined speed, the rotatable roll rotating at a second predetermined speed, the second predetermined speed being substantially greater than the first predetermined speed whereby the particles are separated from the carrier gas, discharging the particles from the rotatable roll to a discharge opening, and recycling the carrier gas. Preferably, the particles comprise wood fibers, and most preferably, the moving web is adapted for the manufacture of wood fiberboard.

In accordance with one embodiment of the method of the present invention, the method includes discharging the particles freely into a space towards the moving web.

In accordance with another embodiment of the method of the present invention, the second predetermined speed is from about two to ten times the first predetermined speed, and more preferably, from about five to eight time the first predetermined speed.

The objects of the present invention are achieved by a device of the kind described above, in which the carrier gas and particles are separated from each other in view of the fact that said roll rotates at a speed which substantially exceeds the speed of the supplied carrier gas, the particles are discharged through an outlet, and the carrier gas is recycled through a return line.

BRIEF DESCRIPTION OF THE DRAWINGS

The present invention may be more fully appreciated with reference to the following detailed description, which, in turn, refers to the drawings in which.

DETAILED DESCRIPTION

Figure 1:
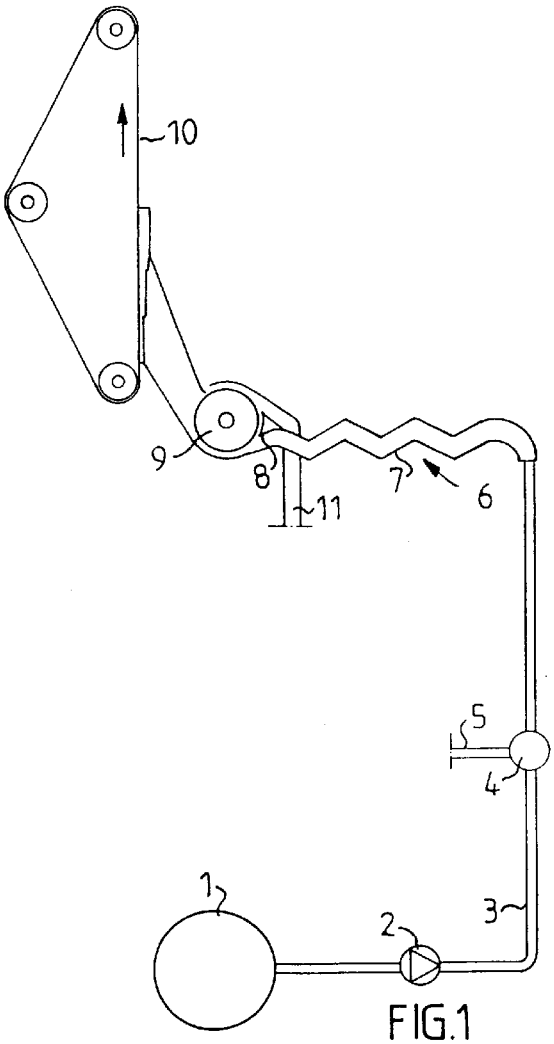
FIG. 1 is a schematic representation of a forming station for wood fiberboard utilizing the present invention.

Referring to the drawings, FIG. 1 shows a forming station for wood fiberboard comprising a preparation station 1 for glue-coated particles, such as wood fibers. The wood fibers are transported by a carrier gas, such as air, by means of a fan 2 through a line 3 to a coarse separator 4. The coarse separator 4 has means 5 for discharging large lumps of wood fibers and the like. After the coarse separator 4 the wood fibers pass through a distribution means 6, which can be designed in accordance with the disclosure in Swedish Patent No. 457,729 and comprise a zigzag-shaped channel 7 with successively increasing width. At the opening of the channel 7 means 8 are located to supply the carrier gas with dispersed fibers to a separation means 9 provided according to the present invention. The separation means 9 spreads out the wood fibers on a running web 10, such as a wire or belt, for transport to a press station (not shown). The carrier gas is recycled after the separation means 9 by means of a return line 11.

Figure 2:
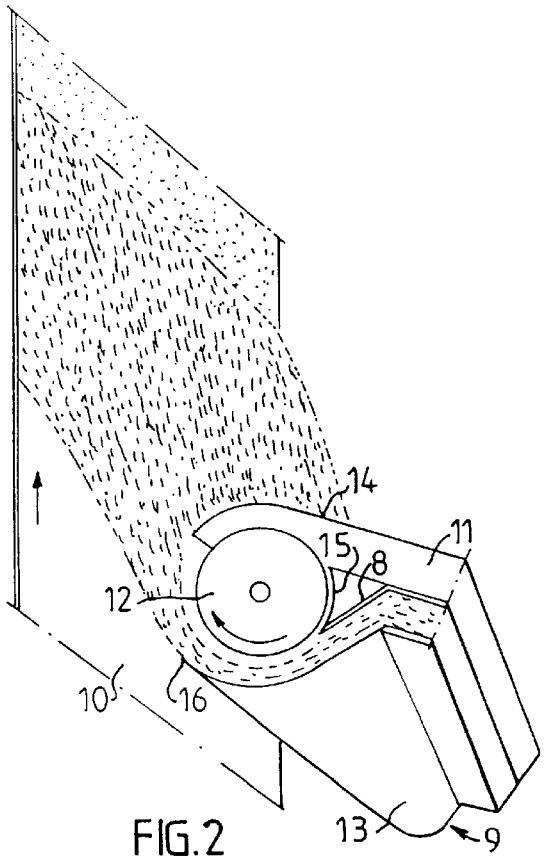
FIG. 2 is an enlarged side, perspective view of the apparatus and method of the present invention.

In FIG. 2 the separation means 9 is shown, which comprises a rotary roll 12, which is partially enclosed in a first case 13 located with respect to the distribution means 6, and a second case 14, located with respect to the return line 11 for the carrier gas. Between the first case 13 and the second case 14 on upwardly extending partition wall 15 is located substantially sealing against the upper portion of the rotary roll 12, and a downwardly extending opening 16 is defined by the lower edges of the first case 13 and the second case 14. The opening 16 opens freely to a subsequent space and is located in the direction facing the running web 10, which is located beneath the separation means 9. A means 8 in the form of an inclined wall or the like is provided for supplying the carrier gas with dispersed particles substantially tangentially to roll 12.

In operation, the roll 12 rotates at a speed substantially exceeding the speed of the supplied carrier gas. The speed is preferably about 2 to 10 times higher than the speed of the carrier gas, whereby a speed gradient of the carrier gas closest to the roll 12 causes the particles to be separated from the carrier gas. The carrier gas follows along around the roll 12 and is recycled by means of the return line 11. The inlet to the return line 11 can comprise a high-speed nozzle, which is preferably located in the opening of the return line 11 in a direction with respect to the roll 12 and as far upstream as possible. In order that as large a portion as possible of the carrier gas is recycled, and at the same time fine particles are not carried along together with the carrier gas, the speed can be chosen to be about 5 to 8 times the speed of the supplied carrier gas. Particles thus tend, by means of centrifugal force, to separate from the roll 12 and be separated from the carrier gas. Depending on the mass of the particles and on the speed of the roll 12, different particles will be separated from the carrier gas at different locations, before they are thrown out through the opening 16 in order, in the subsequent space, to fall down freely onto the running web 10. The carrier gas, however, will substantially entirely follow along around the roll 12 to the partition wall 15, where it is separated and moved into the return line 11 to be recirculated to the preparation station 1.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for separating particles dispersed in a carrier gas being delivered from a distributor to a moving web, said apparatus comprising a rotatable roll, supply means for supplying said particles dispersed in said carrier gas substantially tangentially to said rotatable roll at a first predetermined speed, means for rotating said rotatable roll at a second predetermined speed, said second predetermined speed being substantially greater than said first predetermined speed whereby said particles are separated from said carrier gas, said rotatable roll including a discharge opening for discharging said particles towards said moving web, and a return line for recycling said carrier gas, said return line being disposed directly adjacent to said rotatable roll at a location where said particles have been separated from said carrier gas.

2. The apparatus of claim 1 wherein said particles comprise wood fibers.

3. The apparatus of claim 2 wherein said moving web is adapted for the manufacture of wood fiberboard.

4. The apparatus of claim 1 wherein said discharge opening is adapted to open freely to a space directed towards said moving web.

5. The apparatus of claim 4 wherein said supply means and said return line partially enclose said rotatable roll, and including a partition wall for substantially providing a seal between said supply means and said return line at an upper portion of said rotatable roll.

6. The apparatus of claim 5 wherein said supply means includes a lower edge and said return line includes a lower edge, and said discharge opening is defined by said lower edges of said supply means and said return line.

7. The apparatus of claim 1 wherein said second predetermined speed is from about two to ten times said first predetermined speed.

8. The apparatus of claim 7 wherein said second predetermined speed is from about five to eight times said first predetermined speed.

9. A method for separating particles dispersed in a carrier gas being delivered from a distributor to a moving web, said method comprising rotating a rotatable roll, supplying said particles dispersed in said carrier gas substantially tangentially to said rotatable roll at a first predetermined speed, said rotatable roll rotating at a second predetermined speed, said second predetermined speed being substantially greater than said first predetermined speed whereby said particles are separated from said carrier gas, discharging said particles from said rotatable roll to a discharge opening, and recycling said carrier gas from a location directly adjacent to said rotatable roll where said particles have been separated from said carrier gas.

10. The method of claim 9 wherein said particles comprise wood fibers.

11. The method of claim 10 wherein said moving web is adapted for the manufacture of wood fiberboard.

12. The method of claim 9 including discharging said particles freely into a space towards said moving web.

13. The method of claim 9 wherein said second predetermined speed is from about two to ten times said first predetermined speed.

14. The method of claim 13 wherein said second predetermined speed is from about five to eight time said first predetermined speed.

15. Apparatus for separating particles dispersed in a carrier gas being delivered from a distributor to a moving web, said apparatus comprising a rotatable roll, supply means for supplying said particles dispersed in said carrier gas substantially tangentially to said rotatable roll at a first predetermined speed, means for rotating said rotatable roll at a second predetermined speed, said second predetermined speed being from about 2 to 10 times said first predetermined speed whereby said particles are separated from said carrier gas, said rotatable roll including a discharge opening for discharging said particles towards said moving web, and a return line for recycling said carrier gas.

16. The apparatus of claim 15 wherein said second predetermined speed is from about 5 to 8 times said first predetermined speed.

17. A method for separating particles dispersed in a carrier gas being delivered from a distributor to a moving web, said method comprising rotating a rotatable roll, supplying said particles dispersed in said carrier gas substantially tangentially to said rotatable roll at a first predetermined speed, said rotatable roll rotating at a second predetermined speed, said second predetermined speed being from about 2 to 10 times said first predetermined speed whereby said particles are separated from said carrier gas, discharging said particles from said rotatable roll to a discharge opening, and recycling said carrier gas.

18. The method of claim 17 wherein said second predetermined speed is from about 5 to 8 times said first predetermined speed.

* * * * *